US008672034B2

(12) United States Patent
Al-Ajmi et al.

(10) Patent No.: US 8,672,034 B2
(45) Date of Patent: Mar. 18, 2014

(54) WELL SYSTEM WITH LATERAL MAIN BORE AND STRATEGICALLY DISPOSED LATERAL BORES AND METHOD OF FORMING

(75) Inventors: Fahad Al-Ajmi, Dhahran (SA); Ahmed Alhuthali, Dhahran (SA)

(73) Assignee: Saudi Arabian Oil Company (SA)

( * ) Notice: Subject to any disclaimer, the term of this patent is extended or adjusted under 35 U.S.C. 154(b) by 402 days.

(21) Appl. No.: 13/089,436

(22) Filed: Apr. 19, 2011

(65) Prior Publication Data

US 2012/0267171 A1 Oct. 25, 2012

(51) Int. Cl.
*E21B 17/01* (2006.01)

(52) U.S. Cl.
USPC ..... 166/313; 166/52

(58) Field of Classification Search
USPC ..... 166/313, 52
See application file for complete search history.

(56) References Cited

U.S. PATENT DOCUMENTS

| | | | | |
|---|---|---|---|---|
| 5,762,149 | A | 6/1998 | Donovan et al. | |
| 6,119,776 | A | 9/2000 | Graham | |
| 6,729,394 | B1 | 5/2004 | Hassan | |
| 7,360,595 | B2 | 4/2008 | Zupanick et al. | |
| 7,866,414 | B2 | 1/2011 | Patel | |
| 7,964,741 | B2 * | 6/2011 | Shi et al. | 549/41 |
| 2003/0106686 | A1 * | 6/2003 | Ingle et al. | 166/245 |
| 2004/0050554 | A1 | 3/2004 | Zupanick | |
| 2006/0157242 | A1 | 7/2006 | Graham et al. | |
| 2008/0185149 | A1 | 8/2008 | Seams | |
| 2010/0230096 | A1 | 9/2010 | Gardes | |
| 2011/0005767 | A1 * | 1/2011 | Muff et al. | 166/345 |
| 2011/0017445 | A1 | 1/2011 | Freyer | |
| 2011/0042083 | A1 | 2/2011 | Sierra et al. | |

OTHER PUBLICATIONS

PCT Notification of Transmittal of the International Search Report and the Written Opinion of the International Searching Authority, or the Declaration; dated May 28, 2013; International Application No. PCT/US2012/033885; International File Date: Apr. 17, 2012.

N.G. Saleri, et al., "The Expanding Role of the Drill Bit in Shaping the Subsurface," Distinguished Author Series, SPE84923, Copyright 2003 , Society of Petroleum Engineers.

* cited by examiner

*Primary Examiner* — William P Neuder
(74) *Attorney, Agent, or Firm* — Bracewell & Giuliani LLP

(57) ABSTRACT

A wellbore system and a method of forming the wellbore system, where the wellbore system is made up of a primary wellbore that is disposed entirely above a producing zone and lateral wellbores that extend from the primary wellbore into the producing zone. By penetrating the producing, or target, zone with the lateral wellbores, fractures in the target zone can be better avoided thereby increasing the potential amount of recoverable hydrocarbon. Optionally, wellbore systems are included that have more than a single primary wellbore. Further disclosed is a method of maximizing wellbore production by selectively blocking designated lateral wellbores in which water or other non-hydrocarbon fluid is detected.

17 Claims, 6 Drawing Sheets

WELL SYSTEM WITH LATERAL MAIN BORE AND STRATEGICALLY DISPOSED LATERAL BORES AND METHOD OF FORMING

BACKGROUND OF THE INVENTION

1. Field of the Invention

The present invention relates to a subterranean hydrocarbon producing well system. More specifically, the invention relates to a well system having a main bore that extends above a producing formation with lateral bores that depend from the main bore and intersect the producing formation.

2. Description of the Related Art

Shown in a side partial sectional view in FIG. 1 is a prior art example of a wellbore system and that penetrates through formation layers 12 shown located at various depths below the Earth's surface. The wellbore system 10 typically includes a main bore 14 that projects into a target layer 16 within one of the formation layers 12. Generally, there is no crossflow between the individual formation layers 12. Accordingly, wellbore systems 10 must extend into the target layer 16 in which connate fluid can be produced. Often, the wellbore system 10 will include lateral wells 18 that branch from the primary or main bore 14 into different portions of subterranean formation, and often branch at different depths from the main bore 14. Due to natural or applied stresses in the rock matrix, fractures 20 are usually present in formation layers 12, such as the fractures 20 shown disposed within the target layer 16. As is known, the fractures 20 may provide a fluid flow path of downhole or connate fluid that can include hydrocarbons and/or water. In the prior art example of FIG. 1, the lateral wellbores 18 and the primary well 14 may intersect one or more of the fractures 20.

SUMMARY OF THE INVENTION

Disclosed herein is a method of forming a wellbore. In an example embodiment the method includes boring a primary wellbore from surface to a depth and forming a motherbore from the primary wellbore. The motherbore extends generally horizontal and remains at a depth above a target zone; lateral wellbores are formed that extend from the motherbore to a depth deeper than any portion of the motherbore. The target zone is penetrated with the lateral wellbores while the lateral wellbores are formed to avoid fractures in the target zone. An advantage of forming the motherbore in the non-producing formation is to allow for more flexibility in forming the lateral wellbores. In an optional embodiment, drainage of connate fluid from the target zone is controlled by strategically regulating flow through selective lateral wellbores. Alternatively, control valves can be set in the lateral wellbores and selectively opened and closed to regulate flow through selective lateral wellbores. Moreover, flow from lateral wellbores that produce a set amount of a designated fluid can be selectively blocked. Examples of designated fluid water, brine, and non-hydrocarbon fluids. In an example embodiment, the motherbore can be lengthened and lateral wellbores can be formed from the lengthened portion of the motherbore to a depth deeper than any portion of the lengthened portion of the motherbore and into the target zone. Optionally, a substantial portion of the primary wellbore is generally vertical. In an example embodiment, the lateral wellbore depends generally horizontally away from the motherbore and then extends generally vertically into the target zone. In an example embodiment, the lateral wellbores extend generally horizontally within the target zone. In an example embodiment, another primary wellbore connects to the original primary wellbore, where both the another and original primary wellbore each have a motherbore as described above with corresponding lateral wellbores. The step of boring from the surface occurs at a drill site that is outside of a residential area and wherein at least some of the lateral wellbores are beneath the residential area. In an example embodiment, the presence of water in a lateral wellbore monitored, and flow through the wellbore is regulated with a control valve based on an amount of water measured in the lateral wellbore.

Also disclosed herein is an alternate method of forming a wellbore that includes boring a primary wellbore from surface to a subterranean depth and forming a motherbore that extends from the primary wellbore through subterranean matter lying above a target zone. A lateral wellbore is formed from the motherbore that extends deeper than the motherbore and penetrates the target zone. In an example embodiment, the method includes navigating around subterranean fractures when forming the lateral wellbore. In an example embodiment, a flow of a connate fluid out of the target zone is controlled by regulating flow through the lateral wellbore. In an example embodiment, additional lateral wellbores are added that extend from the motherbore and penetrate the target zone. In an example embodiment, a composition of a flow of fluid through the lateral wellbore is monitored, and the flow of fluid through the lateral wellbore is regulated based on the monitored composition. In an example embodiment, the flow of fluid through the lateral wellbore is blocked when a designated amount of water is monitored in the composition.

BRIEF DESCRIPTION OF THE DRAWINGS

So that the manner in which the above-recited features, aspects and advantages of the invention, as well as others that will become apparent, are attained and can be understood in detail, a more particular description of the invention briefly summarized above may be had by reference to the embodiments thereof that are illustrated in the drawings that form a part of this specification. It is to be noted, however, that the appended drawings illustrate only preferred embodiments of the invention and are, therefore, not to be considered limiting of the invention's scope, for the invention may admit to other equally effective embodiments.

DETAILED DESCRIPTION OF THE EXEMPLARY EMBODIMENTS

Figure 1:
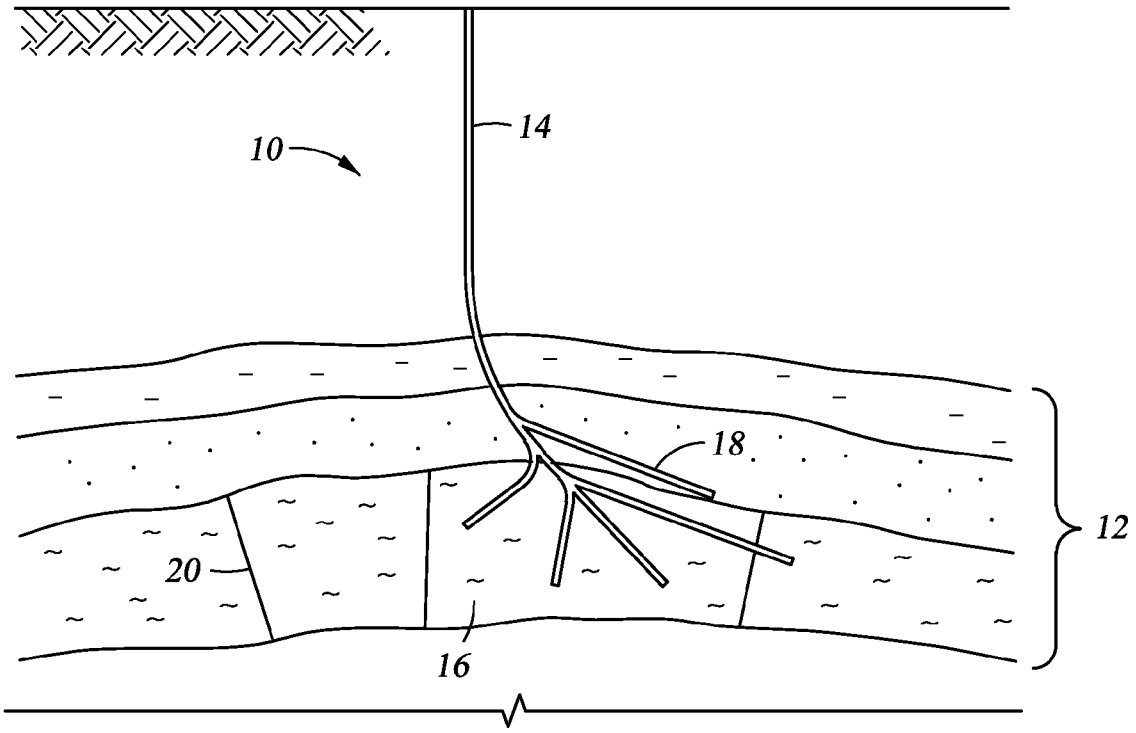
Fig. 1 (PRIOR ART)
FIG. 1 is a side sectional view of a prior art wellbore system formed in the subterranean formations.
Figure 2:
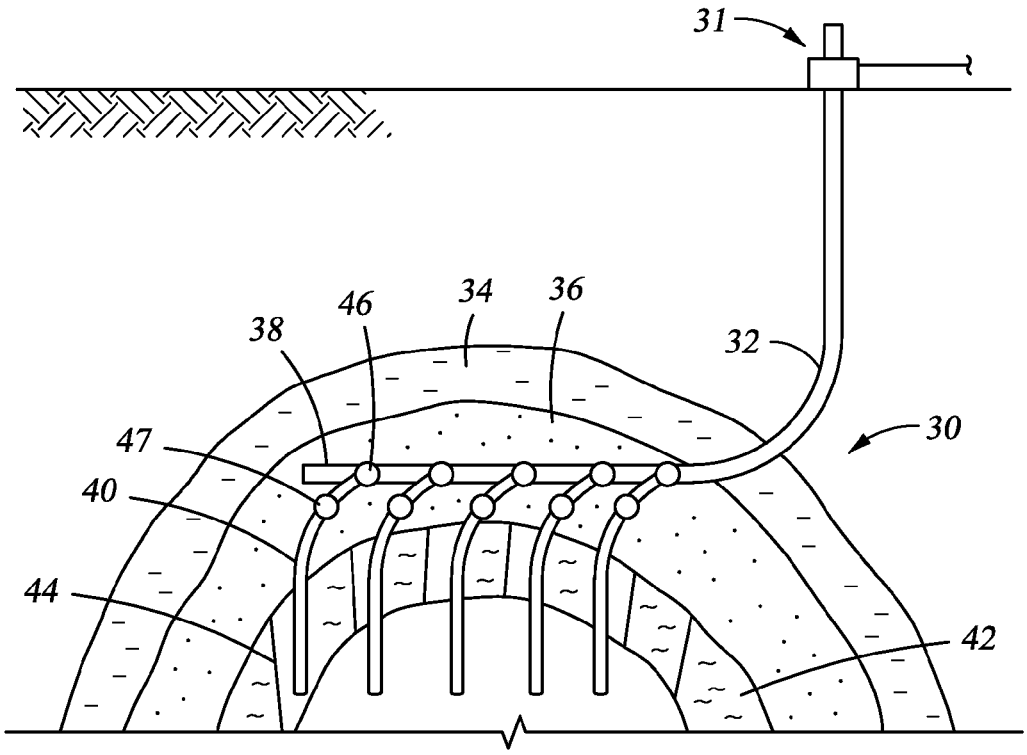
FIG. 2 is a side sectional view of an example embodiment of a wellbore system of the present invention.

FIG. 2 provides in a side sectional view one example embodiment of a well system 30 shown depending from a wellhead assembly 31 on the Earth's surface. In the embodiment of FIG. 2, the portion of the well system 30 connected to the wellhead assembly is referred to as a primary wellbore 32, and is shown bored downward to a designated depth and into a formation 34. Shown beneath the formation 34 is a non-producing formation 36, that may optionally be referred to as caprock. The primary wellbore 32 transitions into a motherbore 38 proximate the interface between the formation 34 and non-producing formation 36; and as shown, the motherbore 38 remains at generally the same depth along its length and entirely within the non-producing formation 36. A series of lateral wellbores 40 extend from the motherbore 38 and deeper into an underlying target formation 42 that is shown at a depth below the non-producing formation 36. For the purposes of disclosure herein, example embodiments exist where the motherbore 38 is partially or entirely within a formation above, or at a lower depth than, the non-producing formation 36. However, as illustrated in the embodiment of FIG. 2, the motherbore 38 remains above the target formation 42.

Example fractures 44 are illustrated within the target formation 42, as illustrated in FIG. 2, the lateral wellbores 40 are disposed between and do not intersect the fractures 44, thereby avoiding the possible flow paths that may exist along the fractures 44. One of the advantages of the present disclosure is the ability to produce fluid from a subterranean formation without intersecting any of the fractures 44. Not only does this allow access to all or most of the target zone 42 via the motherbore 38, but also enables penetration of the target formation 42 without intersecting the fractures 44. It should be pointed out that the fractures 44 can be naturally occurring or produced artificially, such as by hydraulic fracturing.

Still referring to FIG. 2, shown proximate the intersection of the lateral wellbores 40 and the motherbore 38 are optional control valves 46 for regulating flow from the lateral wellbores into the motherbore 38. For example, as will be discussed in more detail below, the control valves 46 may be selectively opened, closed, or partially opened to stop or regulate flow from one or more of the lateral wellbores 40 into the motherbore 38. Also shown are optional monitors 47 disposed in the lateral wellbores 40 that may monitor fluid flow within the lateral wellbores 40 and provide an indication of water content or other non-hydrocarbon fluids within a total flow of fluid.

Figure 3:
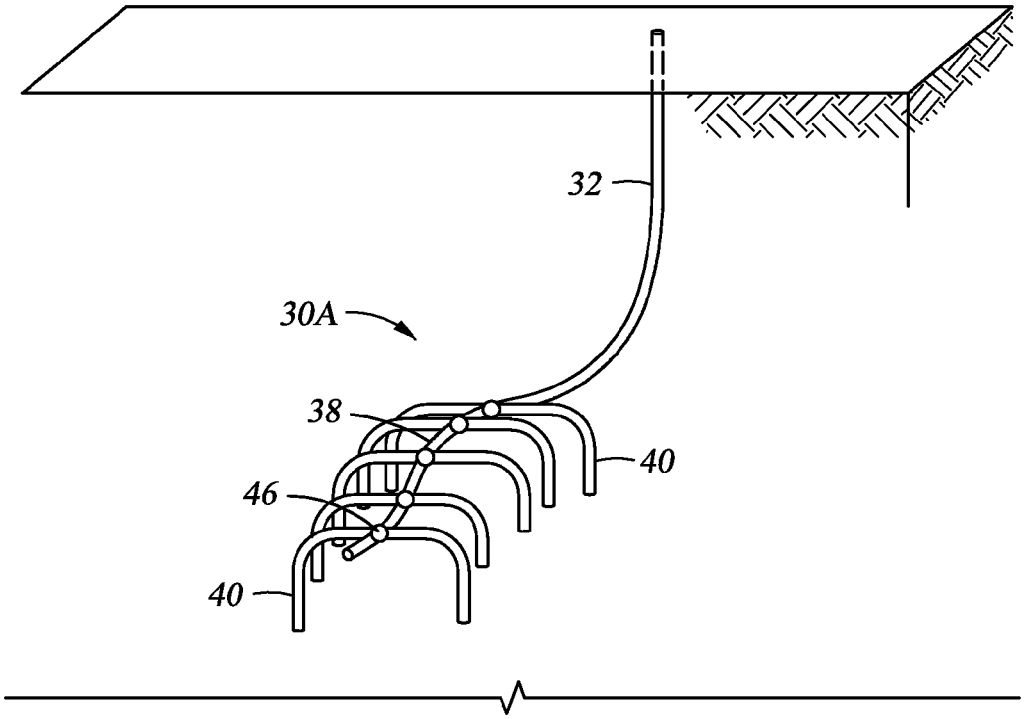
FIG. 3 is a perspective view of an example embodiment of a wellbore system in accordance with the present disclosure.

An alternate embodiment of a well system 30A is shown in a perspective view in FIG. 3. In this example embodiment, the primary wellbore 32 is shown disposed in a generally vertical configuration and then transitioning to a lateral horizontal direction into the motherbore 38. Also, the motherbore 38 takes an undulating path that can not only change depth but azimuthal direction as well. Further illustrated in the embodiment of FIG. 3 is that the lateral wellbores 40 depend from the motherbore 38 on opposing lateral sides and extend a distance at a relatively constant direction and then angle deeper in the formation and away from the motherbore 38. Control valves 46 are shown in the intersection of the lateral wellbores 40 and motherbore 38. However, optional embodiments exist wherein the control valves 46 are set in each leg of the lateral wellbores 40 so that legs from both sides of the motherbore 38 may have a regulating control valve 46 disposed therein.

Figure 4:
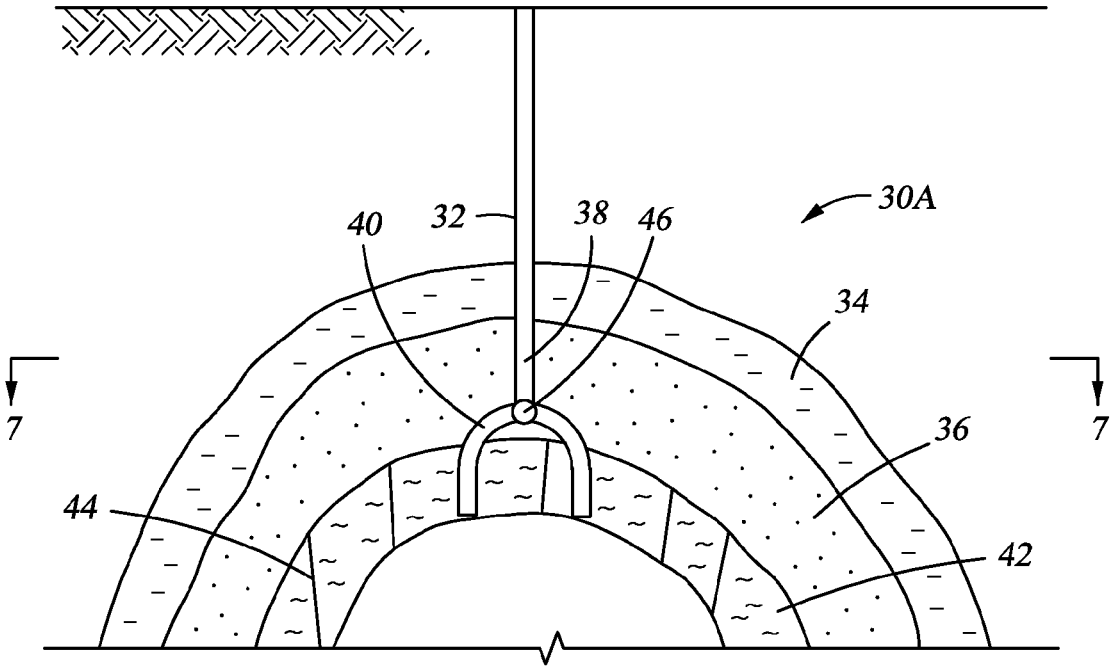
FIG. 4 is a sectional view depicting the embodiment of FIG. 3 within subterranean formations from a frontal view.

FIG. 4 illustrates a sectional view of the well system 30A of FIG. 3 set within subterranean formations. In this example, a view is shown along the axis of the motherbore 38, therein the lateral wellbores 40 penetrate the producing or target zone 42, below the caprock or non-producing formation 36 in which the motherbore 38 is formed. An optional control valve 46 is shown set in the intersection between the lateral wellbore 40 and motherbore 38. Also illustrated is a vertical takeoff of the primary wellbore 32 from an end of the motherbore 38, wherein the primary wellbore 32 projects upward and through the formation 34.

Figure 7:
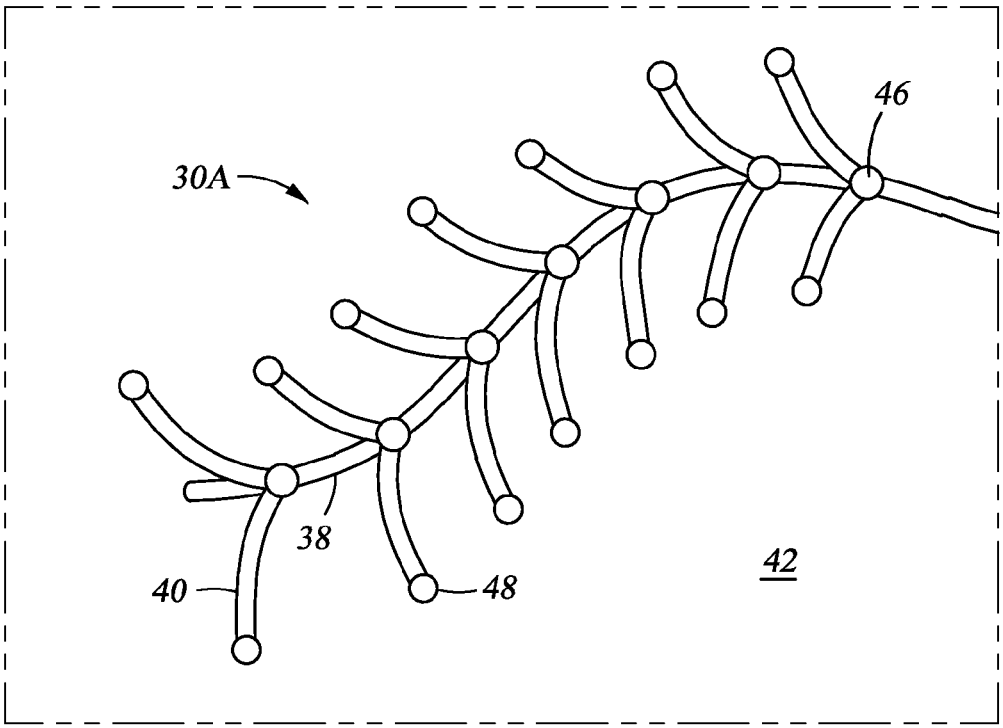
FIG. 7 is an overhead view of the wellbore system of FIG. 4.

Referring now to FIG. 7, a sectional view of the example embodiment of the well system 30A of FIG. 4 is shown and taken along section line 7-7. In this view, the motherbore 38 is shown curving and with a changing azimuthal direction along its length with the lateral wellbores 40 extending downward from lateral side where they intersect the target formation 42 along various penetration points 48.

Figure 5:
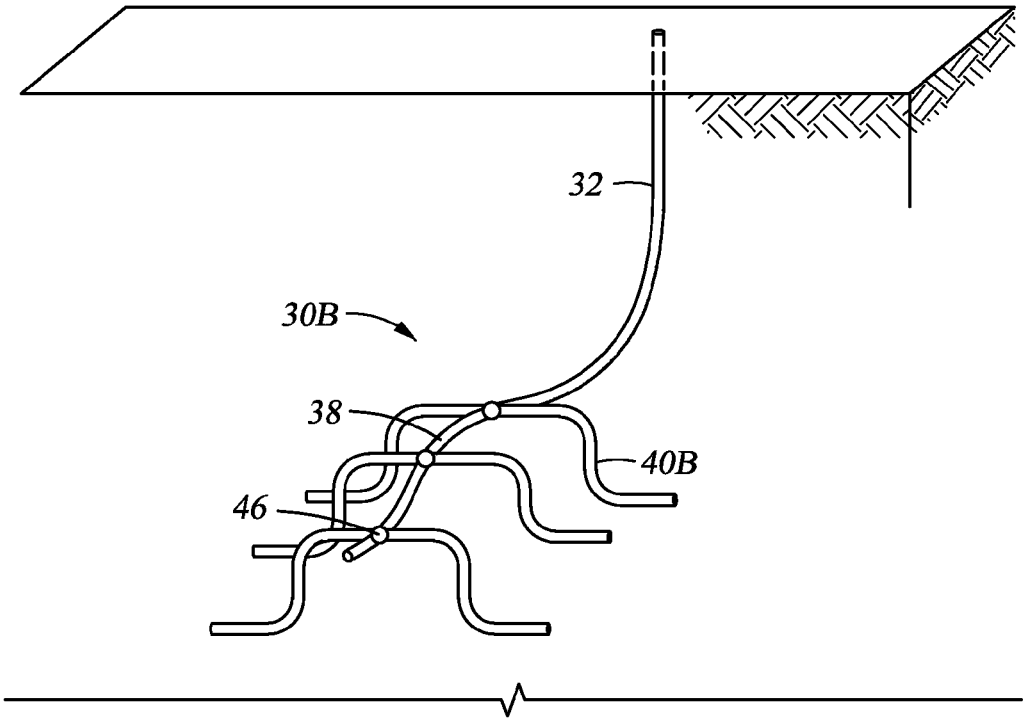
FIG. 5 is an alternate embodiment of a wellbore system in accordance with the present invention.

An alternate example embodiment of a well system 30B is shown in a perspective view in FIG. 5 where the motherbore 38 is shown having lateral wellbores 40B are shown depending from opposing sides where the lateral wellbores 40B extend outward at generally a constant depth, curved to a deeper depth, and then curved again and at a constant depth but away from the motherbore 38.

Figure 6:
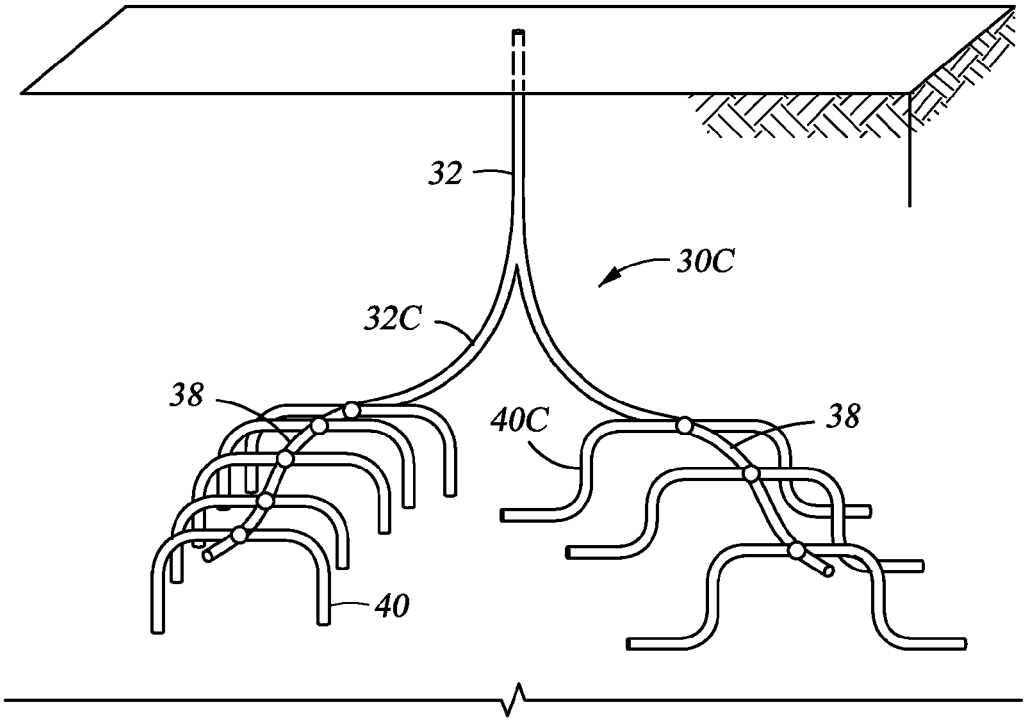
FIG. 6 is another alternate embodiment of a wellbore system in accordance with the present invention.

FIG. 6 depicts another example embodiment of a well system 30C wherein the primary wellbore 32 projects within a subterranean formation where it is intersected by another primary wellbore 32C. Both of the primary wellbores 32, 32C transition into respective motherbores 38. A configuration of the motherbore 38 and associated lateral wellbores 40 joined with the primary wellbore 32C is similar to the configuration of the well system 30A in FIG. 3. The well system shown on the terminal end of the primary wellbore 32 of FIG. 6 is similar to the well system 30B provided in FIG. 5. It should be pointed out however that primary wellbores, in addition to the primary wellbores 32, 32C, may be included within the well system 30C of FIG. 6.

Figure 8:
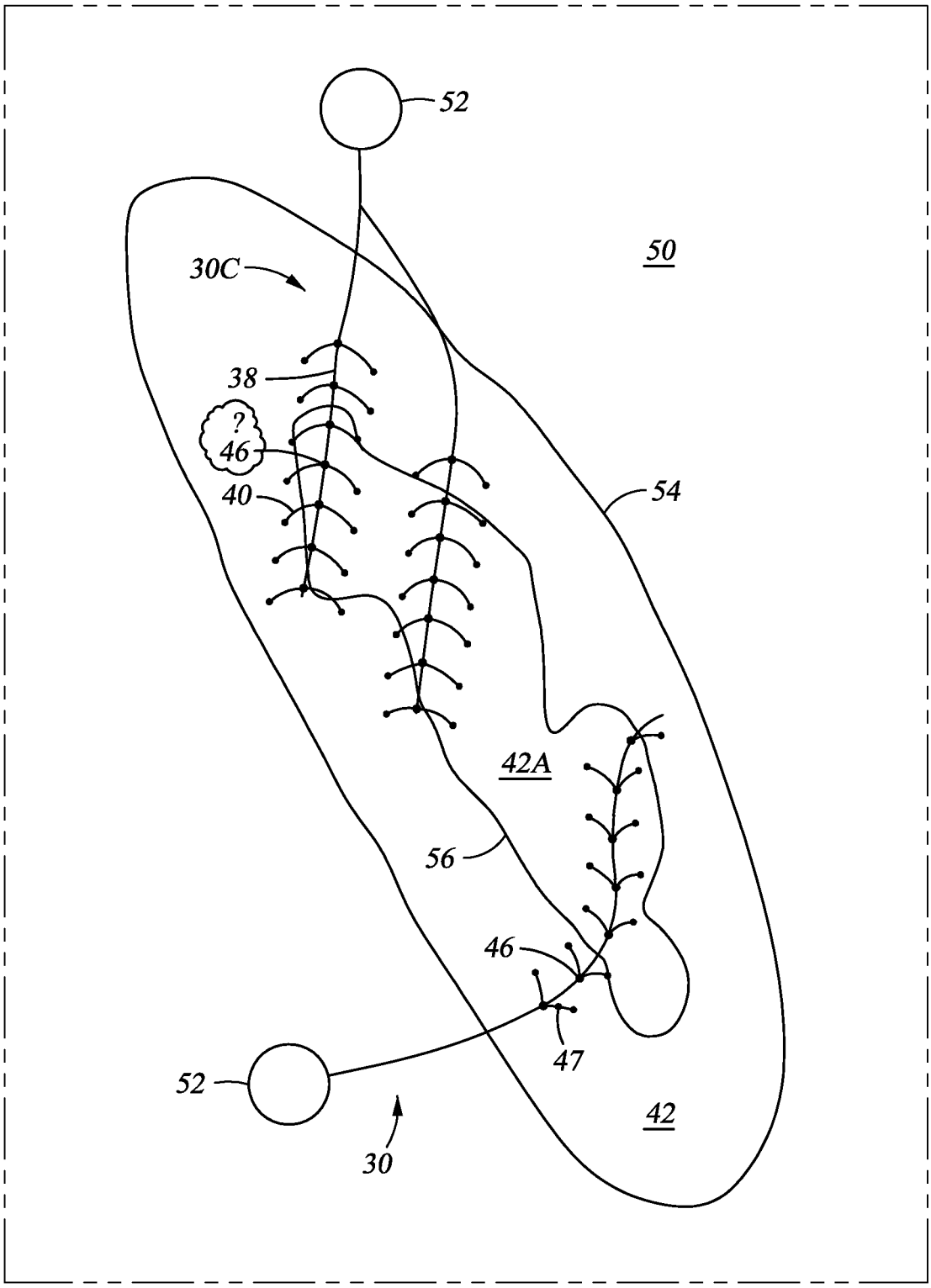
FIG. 8 is an example embodiment of wellbore systems in accordance with the present invention in an oilfield.

Shown in FIG. 8 is an overhead schematic view of well systems 30, 30C formed within an oilfield 50. Each of the well systems 30, 30C initiate from drill sites 52 that are located on the Earth's surface and a distance apart from one another. In the embodiment of FIG. 8, a section of a target formation 42 is provided for reference wherein the drill sites 52 are located at distal positions on either side of the target formation 42. As may occur with many oil fields, hydrocarbons in the target formation 42 are shown pooled within a central location of the oil field 50 and surrounded by water or another non-hydrocarbon fluid. In the example embodiment of FIG. 8, an oil water interface 54 represents the boundary between the pooled hydrocarbons and surrounding water. Over time as the hydrocarbons are depleted from the oilfield 50, the pool begins to diminish and replaced by water as it encroaches towards the mid portion of the pool. Oil water interface 56 illustrates the water and oil boundary at some point in time after production of the field 50. Target formation 42A illustrates an example location of the remaining hydrocarbons. As illustrated in FIG. 8, some of the lateral wellbores 40 within the oil water interface 54 fall outside of the interface 56. As such, it may be desired to reduce or eliminate production from these lateral wellbores 40 outside of the interface 56. Regulating flow from the designated lateral wellbores 40 can be accomplished by selectively opening and closing control valves 46 disposed within the lateral wellbores 40. The monitors 47 may be in communication with the surface via hardwire connections (not shown) disposed up through any of the well systems disclosed herein. Control valve(s) 46 can be actuated based on the readings from the monitor(s) 47, where the step of actuating can be manual or automated, such as with a controller (not shown). A controller can be downhole or at surface. Also optionally, the motherbore 38 can be lengthened and lateral wellbores 40 provided that extend from the lengthened section of the motherbore 38. The step of lengthening can occur before producing from the oilfield 50, or at a later time after the oilfield 50 has been in production for a period of time.

Figure 9:
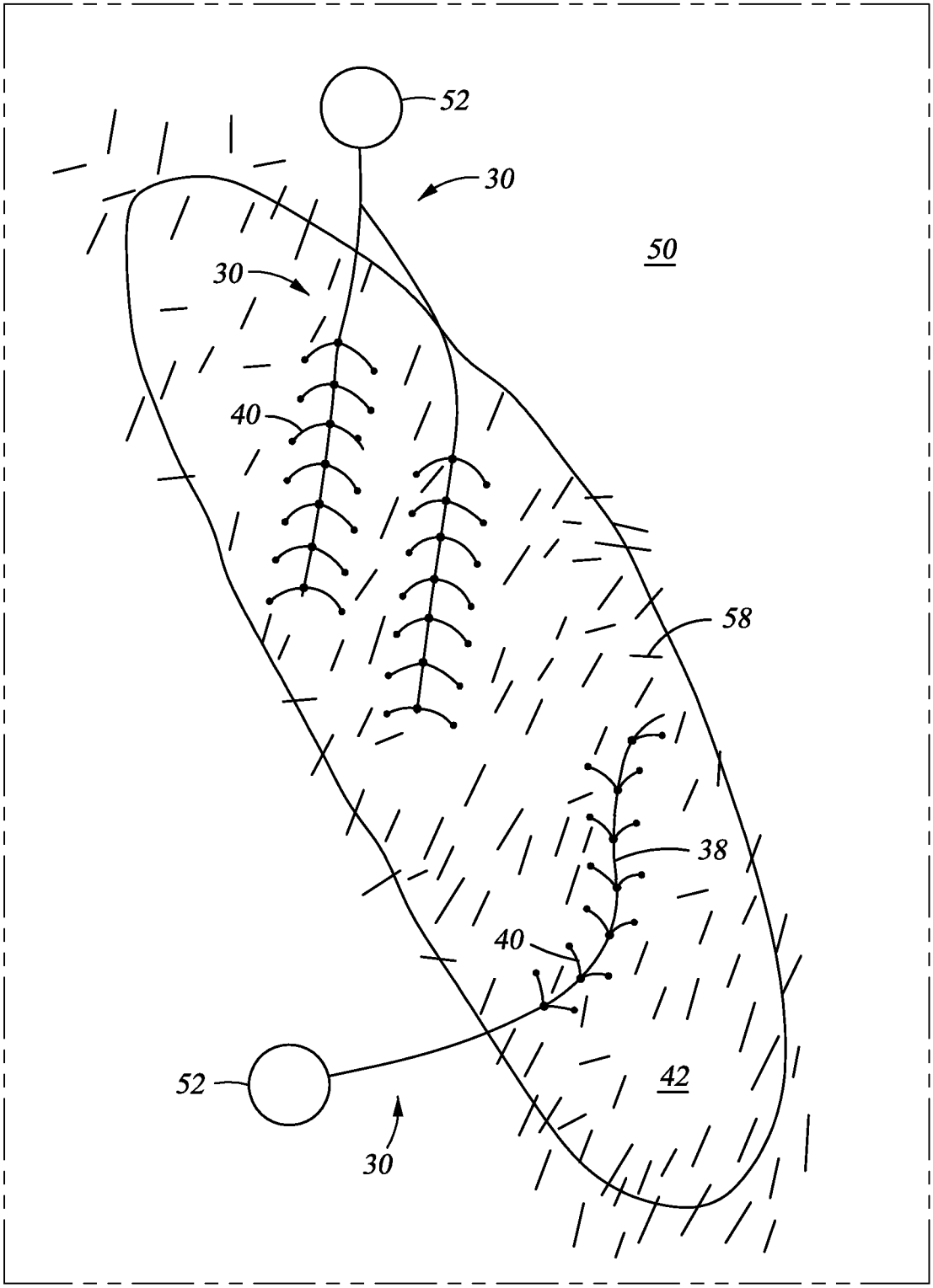
FIG. 9 is an overhead view of example embodiments of wellbore systems in accordance with the present invention in an oilfield and illustrating fractures within the oilfield.

FIG. 9 is an overhead illustration of an oilfield 50 having well systems 30 formed therein wherein one of the well systems 30 is initiated from a drill site 52 and a drill site 52 on a distal side of the target zone 42. In FIG. 9, the drill site on the distal side of the target zone 42 provides a point for initiating two well systems 30. Further illustrated in the example of FIG. 9 are fractures 58 that represent part of a complex fracture system. As can be seen from the embodiment of FIG. 9, strategically orienting the motherbores 38 and lateral wellbores 40 within the oilfield 50 form wellbores that penetrate a hydrocarbon containing target zone 42 without intersecting a fracture 58. This is especially advantageous in situations where a residential area may be present above a designated intersection between a producing wellbore and target zone. Rather than the prior art way of drilling a primary wellbore down at a depth and then laterally into a producing zone, at the risk of intersecting a fracture, the present disclosure allows for access of a producing zone that can avoid subterranean fractures 58.

Figure 10:
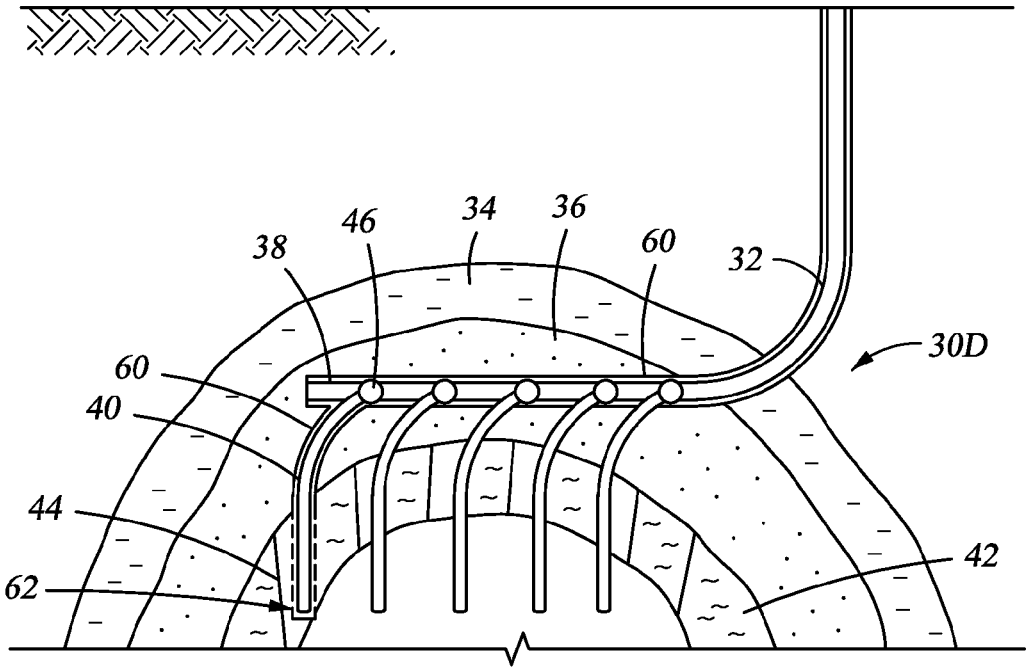
FIG. 10 is a side sectional view of an example embodiment of a wellbore system in accordance with the present invention that is partially lined with tubulars.

Referring now to FIG. 10, a side sectional view of an example embodiment of a well system 30D is illustrated. In the example of FIG. 10, a primary well 32 is shown angling through a formation 34 and transitioning into a motherbore 38 that is within a non-producing formation 36. The primary wellbore 32 and motherbore 38 are both shown having a tubular 60 set therein; the tubular 60 may be casing for protecting the integrity of the bores 32, 38. Further illustrated are lateral wellbores 40 extending into a target zone 42 and in between fractures 44. One or more of the lateral wellbores 40 may be equipped with a tubular 60, shown as an outer casing for protecting the wellbore 40. Optionally, portions may be lined with a perforated tubular 62 for filtering sand and other debris from connate fluid entering the well system 30D. Optionally, the perforations may be formed for inducing flow from the formation 42 and into the well system 30D.

Having described the invention above, various modifications of the techniques, procedures, materials, and equipment will be apparent to those skilled in the art. While various embodiments have been shown and described, various modifications and substitutions may be made thereto. Accordingly, it is to be understood that the present invention has been described by way of illustration(s) and not limitation. It is intended that all such variations within the scope and spirit of the invention be included within the scope of the appended claims.

What is claimed is:

1. A method of forming a wellbore comprising:

(a) boring a primary wellbore from surface to a subterranean depth;

(b) forming a motherbore from the primary wellbore that extends generally horizontal and remains at a depth that is above a target zone;

(c) forming lateral wellbores from the motherbore, each lateral wellbore being formed to a depth deeper than any portion of the motherbore;

(d) penetrating the target zone with the lateral wellbores; and (e) avoiding fractures in the target zone while boring the lateral wellbores within the target zone.

2. The method of claim 1, further comprising controlling drainage of connate fluid from the target zone by strategically regulating flow through selective lateral wellbores.

3. The method of claim 2, wherein control valves in the lateral wellbores are selectively opened and closed to regulate flow through selective lateral wellbores.

4. The method of claim 1, further comprising selectively blocking flow from lateral wellbores that produce a set amount of a designated fluid.

5. The method of claim 1, wherein the designated fluid comprises a fluid selected from the group consisting of water, brine, and non-hydrocarbon fluids.

6. The method of claim 1, further comprising lengthening the motherbore, forming lateral wellbores from the lengthened portion of the motherbore, each lateral wellbore being formed to a depth deeper than any portion of the lengthened portion of the motherbore, and repeating steps (d) and (e).

7. The method of claim 1, wherein a substantial portion of the primary wellbore is generally vertical.

8. The method of claim 1, wherein the lateral wellbores depend generally horizontally away from the motherbore and then extend generally vertically into the target zone.

9. The method of claim 8, wherein the lateral wellbores extend generally horizontally within the target zone.

10. The method of claim 1, wherein the primary wellbore comprises a first primary wellbore, the method further comprising forming a second primary wellbore from the first primary wellbore and repeating steps (b)-(e).

11. The method of claim 1, wherein boring from the surface occurs at a drill site that is outside of a residential area and wherein at least some of the lateral wellbores are beneath the residential area.

12. The method of claim 1, further comprising monitoring the presence of water in a lateral wellbore and regulating flow through the wellbore with a control valve based on an amount of water measured in the lateral wellbore.

13. A method of forming a wellbore comprising:

(a) boring a primary wellbore from surface to a subterranean depth;

(b) forming a motherbore that extends from the primary wellbore and remains above a target zone;

(c) forming a lateral wellbore from the motherbore that extends deeper than the motherbore and penetrates the target zone; and (d) navigating around subterranean fractures when forming the lateral wellbore.

14. The method of claim 13, further comprising controlling a flow of a connate fluid out of the target zone by regulating flow through the lateral wellbore.

15. The method of claim 13, further comprising forming additional lateral wellbores from the motherbore that penetrate the target zone.

16. The method of claim 13, further comprising monitoring a composition of a flow of fluid through the lateral wellbore and selectively blocking the flow of fluid based on the monitored composition.

17. The method of claim 16, wherein the flow of fluid is blocked when a designated amount of water is monitored in the composition.

* * * * *